US006750414B2

(12) United States Patent
Sullivan

(10) Patent No.: US 6,750,414 B2
(45) Date of Patent: Jun. 15, 2004

(54) TACTILE KEYBOARD FOR ELECTRICAL APPLIANCES AND EQUIPMENT

(75) Inventor: Michael J. Sullivan, Barrington Hills, IL (US)

(73) Assignee: Marking Specialists/Polymer Technologies, Inc., Arlington Heights, IL (US)

( * ) Notice: Subject to any disclaimer, the term of this patent is extended or adjusted under 35 U.S.C. 154(b) by 0 days.

(21) Appl. No.: 10/460,081

(22) Filed: Jun. 12, 2003

(65) Prior Publication Data

US 2004/0020754 A1 Feb. 5, 2004

Related U.S. Application Data

(63) Continuation-in-part of application No. 10/173,961, filed on Jun. 18, 2002, now abandoned.
(60) Provisional application No. 60/298,420, filed on Jun. 18, 2001.

(51) Int. Cl.[7] ..... H01H 11/00
(52) U.S. Cl. ..... 200/512; 200/5 A
(58) Field of Search ..... 200/5 A, 512–517

(56) References Cited

U.S. PATENT DOCUMENTS

| | | | | |
|---|---|---|---|---|
| 3,995,126 A | | 11/1976 | Larson | |
| 4,066,850 A | | 1/1978 | Heys | |
| 4,194,097 A | | 3/1980 | Bradam | |
| 4,456,798 A | * | 6/1984 | Iwai et al. | 200/5 A |
| 4,634,818 A | * | 1/1987 | Hayes-Pankhurst et al. | 200/5 A |
| 5,313,027 A | * | 5/1994 | Inoue et al. | 200/5 A |
| 5,561,278 A | * | 10/1996 | Rutten | 200/5 A |
| 6,039,390 A | | 3/2000 | Agrawal et al. | |

* cited by examiner

*Primary Examiner*—Ramon M. Barrera
(74) *Attorney, Agent, or Firm*—Leon I. Edelson; William C. Clarke; Levenfeld Pearlstein, LLC

(57) ABSTRACT

A soft tactile urethane transparent plastic membrane structure printed keyboard is disclosed which provides a soft tactile individual membrane over each separate printed indicia wherein each individual membrane structure is clear, raised, domed, visually transparent and soft to the touch. The soft tactile urethane membrane structures provide raised key tip contact means which permit keyboard operation by feel of the keyboard. The urethane plastic membrane structures, when compressed, activate respective membrane switches in an electrical control circuit.

9 Claims, 1 Drawing Sheet

TACTILE KEYBOARD FOR ELECTRICAL APPLIANCES AND EQUIPMENT

This is a Continuation-In-Part of application Ser. No. 10/173,961 filed Jun. 18, 2002 now abandoned, of provisional application Serial No. 60/298,420 filed Jun. 18, 2001, and claims benefit of the filing date of the provisional application, Serial No. 60/298,420 filed Jun. 18, 2001.

BACKGROUND OF THE INVENTION

1. Field of the Invention

This invention relates to a soft tactile urethane plastic membrane structure printed keyboard for use on data control and recording devices such as data control and data insertion terminals for appliances, security equipment, communication equipment, computers and like equipment wherein manual keyed Inputs are used. The keyboard is adaptible to use of conventional electrical matrix control of electrical devices.

This invention accordingly relates to the control of electrical equipment and appliances and, more particularly, to an improved tactile keyboard.

Keyboards and keypads have long been used to provide codes and data for the operation of numerous kinds of electrical equipment and appliances used by individuals in travel, in the household, and in industry. The first keypads were often depressible keys to transmit codes and data to equipment and appliances for purposes of operation, transmitting information, and utilitarian tasks. In recent years depressible membranes have served in keypad applications but several deficiencies are present in designs frequently used. Often, presently available keyboards are expensive to manufacture and fail to provide an optimum lifetime of service, including keyboards of injection molded keys.

As an additional problem in current keyboards, some individual key positions in the key array of current keyboards are not characterized by suitable delineation to cause positive tactile finger positioning to the user which is advantageous to the individual operating the device. This is particularly a problem where a tactile differential between individual keys is not present because surface indication of the key being depressed is not present. Such problems arise because of the lack of three-dimensional tactile differential being present for the user.

Further, current keyboards can require relatively expensive and uneconomical steps of fabrication in that many plastic layers are utilized in one keyboard product. Also, the limit of service of a membrane switch can be limited in a membrane switch activated a few thousand times. Therefore, it Is desirable to provide a keyboard having optimum three-dimensional domed shape keys having improved feel, visual distinctiveness, with economy of manufacture and improved service capability.

2. Description of the Prior Art

Data terminal devices are used in retail establishments such as restaurants, wherein individual food servings are tabulated and charged per item before being served, in supermarkets or in fast food establishments which require fast checkout operations, and in similar business operations wherein emphasis is on fast manual checkout service to serve the customer quickly, yet with accurate recording of the details of the service provided. The required speed of recording each transaction has been facilitated by the use of tactile keyboards wherein the keyboard operator records each transaction by feel of the keyboard to depress keyboard keys by touch typing or touch sensation. Because many keyboards have relatively flat contact surfaces which indicate positions of keys or contacts, recording errors can arise or the operator needs to observe the position of the desired key or contact before depressing the contact surface, thus decreasing the speed of the operation.

In the prior art, a number of patents discuss the problem of providing keyboards for terminal services wherein the keyboard provided comprises a membrane or jacket cover member with raised proturbances or bubbles, or with raised key tip portions to facilitate the operator's tactile response to keyboard key positions by touch typing or touch sensation.

U.S. Pat. No. 3,995,126, to Larson, teaches a membrane keyboard apparatus wherein the membrane comprises a flat non-conductive sheet such as Mylar plastic film having an array of dome-shaped deflectible bubble members containing air, being selectively deformable to form a conductive path between electrodes with air tunnel means to allow air to escape from deflected individual bubble members and distribute the air to remaining bubble members from the deflected bubble members of the Mylar plastic sheet. Air tunnels are taught as particularly desirable when a sealed type keyboard apparatus is used. The keyboard apparatus comprises several layers consisting of a layer of a plastic molding or bezel member having a plurality of apertures exposing individual switching units, a bridging layer of a conductive metal material such as metallic foil, and an insulator layer consisting of an insulating member covering electrical leads from individual switching units. The Larson membrane keyboard apparatus accordingly comprises an insulator having a conductive sheet with a plurality of electrode members in apertures in a deflectible membrane sheet with resilient air filled plastic sheet formed bubbles actuable by touch. The insulator comprises several layers of non-conducting film sheets and conducting sheets with electrode members to provide a switching apparatus actuable by touch. Larson '126 teaches that previous keyboard switches using air filled bubble members are subject to multiple switch closure when the air within the bubble is compressed and causes switch closure before the bubble member contacts to close the switch. The air escape of Larson '126 prevents multiple switch closure.

U.S. Pat. No. 4,066,850, to Heys teaches a keyboard switch assembly comprising a transparent plastic material of raised portions simulating key tips formed in any well known manner such as molding. The assembly comprises a waterproof jacket of a cover member, a key tip sheet, an indicia sheet, a projection sheet of a plurality of depending projections oriented with associated key tips to produce pressure points on the key tip portion and a matrix switch unit thereby. Plastic materials such as polyvinylchloride, polyethylene, and other plastics are used. The keyboard assembly comprises a waterproof printed circuit matrix unit and a waterproof jacket as a data terminal device that will operate under conditions where liquids and food may be spilled on the keyboard. Transparent plastic materials provide visual access to indicia on the keyboard.

U.S. Pat. No. 4,194,097 to Bradam teaches a membrane keyboard apparatus with tactile feedback comprising a printed circuit keyboard including a cover sheet of insulating material of a flexible plastic having a plurality of spherical proturbances or bubble portions formed in any well-known manner such as molding. The cover sheet is of resilient material such that after depression the bubble portions will spring back to their raised portion. Each bubble may have printed on its upper surface an indicia representing the key designation as is conventional. Secured to the lower surface of each bubble is a flexible electrical conductor. An insulator spacer sheet is positioned adjacent the cover sheet having a plurality of apertures in register with each bubble of the cover sheet. Adjacent the spacer sheet is a flexible support sheet having bubble portions in register with apertures in the insulator spacer sheet and associated bubbles in the cover sheet. The above sheets are mounted upon a printed circuit board wherein the printed circuit board has a plurality of recessed portions in registration with the bubble portions of the above sheets. In operation, depression of a selection bubble in the cover sheet makes electrical contact with electrical conductors in the flexible support sheet. The tactile feedback to the operator permits the operator to learn the location of each bubble portion and to operate the keyboard without looking at the keyboard.

U.S. Pat. No. 6,039,390 to Agrawal discloses a chromogenic window panel assembly and a chromogenic light pipe devices. The chromogenic light pipe has a light harvesting member to harness exterior light on a building and direct the light to the interior of the building. The main element of the light pipe is a circular tube that extends through the roof of the building and the tube end is covered with a clear cover to collect outside light. The tube ends inside the building at the ceiling surface where the tube end is covered with a diffuser that spreads to collect light across the interior area of the building. The diffuser can be an attached lens which serves as a diffuser and spreads the tube light in a desirable pattern. The embodiment of a chromogenic light pipe accordingly can include an optical lens for transmitting light and diffusing transmitted light in a desirable pattern rather than as an optical visual aid.

Although aspects of the instant invention are taught in the prior art, i.e., the prior art teaching a membrane keyboard apparatus comprising a flat non-conductive plastic sheet having an array of formed bubble members, the bubble members air-filled with air tunnels to allow air to be distributed to other bubble members, a keyboard switch assembly of transparent plastic material with raised portions of the plastic material simulating key tips, a membrane keyboard apparatus including a cover sheet of plastic insulating material having a plurality of spherical or bubble portions of resilient material to spring back after depression, each bubble having indicia printed on its upper surface for the key designation, and the prior art teaching a lens for diffusing, spreading and transmitting light as being a well-known application of a formed lens of a transparent curved material, the keyboard of the present invention comprising a soft tactile urethane plastic membrane structure over separate printed indicia on one surface of a polycarbonate sheet and the unique method of preparation of the keyboard soft urethane plastic membrane structure of the present invention have not been disclosed in the prior art The instant invention comprises a keyboard wherein a tactile solid urethane plastic membrane structure is individually formed and applied over each individual printed indicia by application of a printed ink barrier outline around each selected individual printed Indicia location and heated flowable urethane plastic is applied over each location within the bounds of the printed ink barriers. The hardening of the flowable urethane plastic results in a clear, raised plastic structure with a domed surface within the barrier outline, which allows the user to view the underlying indicia through the transparent plastic material. Additional elements of the transparent plastic membrane product structure and process of preparation of the transparent plastic membrane product structure of the instant invention differentiate the invented transparent plastic membrane product structure and process of preparation from products and processes taught in the prior art. The additional elements include the application of flowable transparent urethane plastic material within a periphery outline of an ink barrier, the ink barrier comprising a printed ink barrier, the hardening of the flowable transparent urethane plastic within the periphery ink barrier outline to a clear transparent raised domed surface of an individual tactile urethane plastic membrane structure over a visually available printed indicia on a polycarbonate surface. In contradistinction to the instant invention, the prior art teaches membrane type keyboards wherein the membrane typically comprises a plastic sheet with a plurality of bubble portions or spherical proturbances formed in any well-known manner such as molding which deform and spring back after depression to activate a key or an electrical contact under the bubble portion.

SUMMARY OF THE INVENTION

This invention relates to a soft tactile urethane transparent plastic membrane covered printed keyboard and to the preparation of the keyboard by a conventional printing process and a conventional plastic application process using a urethane transparent plastic in a flowable state wherein the keyboard comprises a soft tactile urethane plastic membrane structure over each separate printed indicia on one surface of a polycaronate base sheet, each soft tactile membrane structure over each separate printed indicia characterized as clear, raised, domed, and visually transparent. A conventional integral electrical contact matrix therein the polycarbonate base sheet is positioned and in alignment with each separated printed indicia and provides a means of electrical control of equipment. The polycarbonate base sheet upon which the indicia are printed has a textured surface to increase wear resistance to sustained use and to improve durability and scratch resistance. Each soft tactile membrane structure, when compressed, activate respective switches in an electrical control circuit.

BRIEF DESCRIPTION OF THE DRAWINGS

FIG. 2 illustrates a conventional integral embedded or inscribed electrical matrix 18 in the polycarbonate layer 6.

DESCRIPTION OF THE PREFERRED EMBODIMENTS

Figure 1:
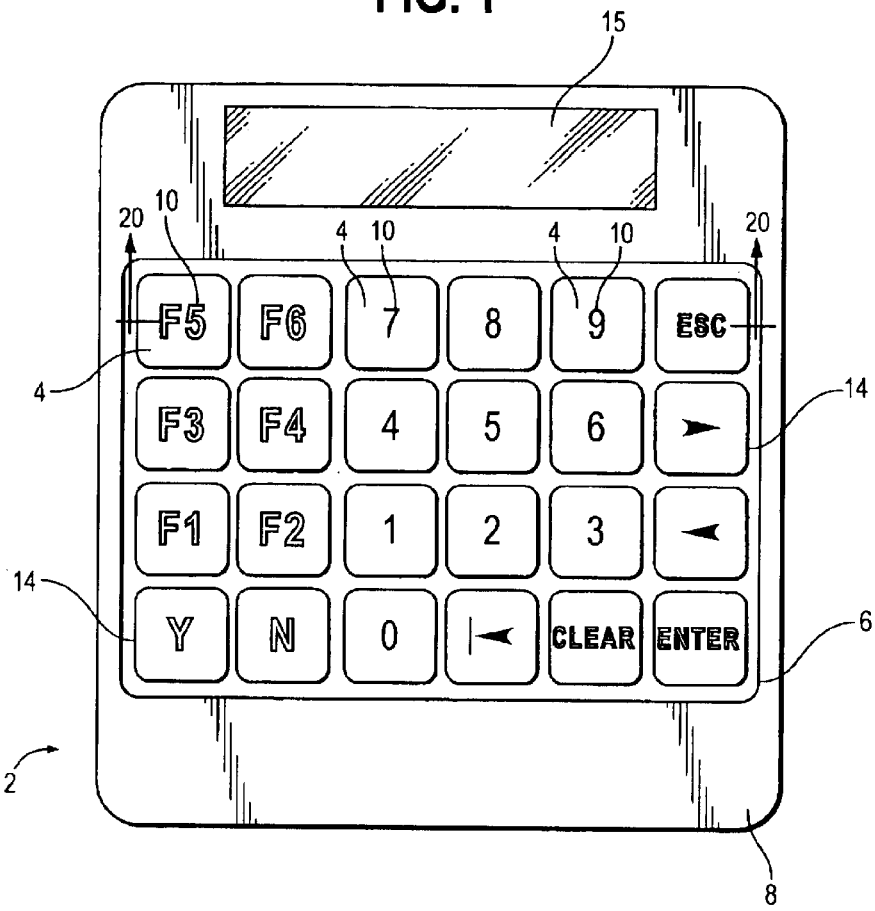
FIG. 1 is a top plan view of one embodiment designated as 2 of the tactile keyboard of the invention. The view shows the thin layer of polycarbonate 6 which is printed with indicia 10 and the individual separated transparent urethane plastic membrane structures 4 over each individual indicia 10, each transparent urethane plastic membrane 4 within the periphery of the printed ink barrier 14. The thin layer of polycarbonate 6 is mounted on the support substrate 8 which can be any suitable plastic polymer including polycarbonate. The support substrate 8 has an identification panel 15.
Figure 2:
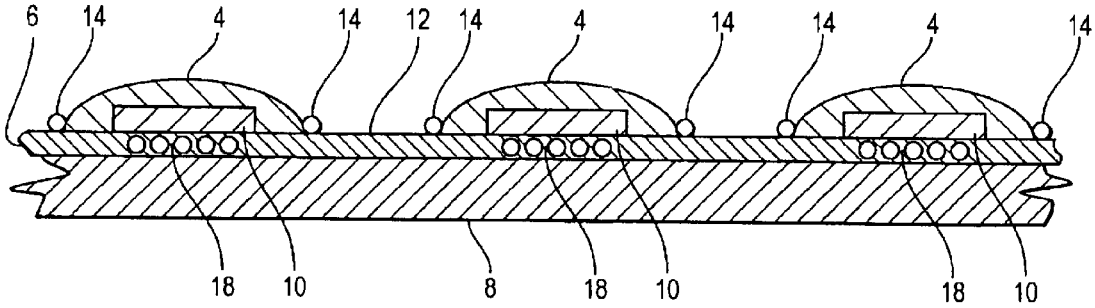
FIG. 2 is a cross-sectional view of FIG. 1 along the planes of the section lines 20—20 illustrating the construction of the embodiment of FIG. 1 showing the printed ink barrier outline 14 around each printed indicia 10 and the transparent urethane plastic membrane 4 over the printed indicia 10 on the external surface 12 of polycarbonate layer 6 mounted by adhesive means on support substrate 8.

Referring to FIGS. 1 and 2, there Is illustrated an embodiment of a keypad, a small often handheld keyboard of the instant invention. The keypad embodiment, designated as 2, includes a plurality of soft tactile urethane plastic membrane structures 4 surrounded by printed ink barrier outlines 14, said membrane structure 4 located over printed indicia 10, printed on surface 12 of the support surface of plastic sheet 6 which, in turn is mounted on plastic substrate 8 by conventional means such as suitable adhesives. Printed indicia 10 printed on surface 12 of plastic sheet 6 over an embedded or inscribed electrical matrix 18 exemplifies a conventional means of controlling electrical equipment by the invented keyboard. The individual indicia are in the form of numbers, letters and icons to designate an operation element of controlled electrical apparatus.

The integral electrical control matrix can be of any conventional electrical control matrix utilized for electrical control of equipment wherein electrical contact switches operate to control electrical equipment. The positioning and alignment of the integral electrical matrix with the individual indicia of the keyboard are required essential elements of the invented keyboard for operation of the invented keyboard.

Referring to FIG. 2, FIG. 2 is a cross-sectional view of FIG. 1 along the planes of the section lines 20—20 of FIG. 1 with the individual printed barrier outlines 14 shown in outline, the printed indicia 10 printed on surface 12 of plastic sheet 6, the clear raised plastic structure 4 with a domed surface within the printed ink barrier outline 14. FIG. 2 also indicates the relative thickness of the thin polycarbonate plastic sheet 6 upon which indicia 10 are printed and the thickness of support plastic substrate 8.

FIG. 2 illustrates the operation of the invented keyboard by use of a conventional integral electrical switch matrix 18 positioned and in alignment with said individual printed indicia printed on the surface 12 of plastic sheet 6 to provide operational elements of the controlled electrical apparatus. The said integral matrix can be embedded or inscribed therein or adhered thereto in a conventional process to said plastic sheet 6 including actuating switch members to control said electrical apparatus. The embedding or inscribing of the electrical switch matrix 18 therein plastic sheet 6 is performed prior to printing of indicia 10 upon the plstic sheet 6.

As shown in FIGS. 1 and 2, the keyboard 2 illustrates a plurality of three dimensional dome-shaped soft tactile transparent urethane plastic membrane structures 4 over covered indicia 10 representing contact locations for external control functions of an electrical matrix. The raised domed soft tactile transparent urethane plastic membrane structures 4 are arranged to be manually compressed to activate an integral electrical switch matrix of conventional design, each electrical switch associated with each of the plurality of compressable membrane structures over the individual printed indicia. The raised domed soft tactile transparent urethane plastic membrane structures 4 and integral electrical switch matrix 18 can be arranged in any geometric pattern and are tactilely separate and tactilely distinguishable from each other.

The soft tactile transparent urethane plastic membrane structures 4 are applied in a heated flowable state by conventional procedures onto polycarbonate layer 6, a polycarbonate plastic sheet sold under the trademark LEXAN by General Electric. The LEXAN polycarbonate sheet as supplied by General Electric Company is transparently clear and possesses a velvet-like texture surface but which is not a textured surface such as would increase printing production costs for printing the required printed indicia 10 and printed ink barrier outlines 14 on polycarbonate layer 6. The velvet-like texture surface of LEXAN polycarbonate sheet also is scratch-resistant and does not require a scratch resistant process to prevent the surface from scratching. The thickness of the LEXAN polycarbonate sheet 6 can be in the range of from about 0.01 to 0.03 inches thick although greater and lesser thicknesses can be used.

The individual raised domed soft tactile transparent urethane plastic membrane structures 4 are formed by pouring a flowable urethane plastic in a heated state into an area on surface 12 of polycarbonate sheet 6 designated by an ink barrier outline 14. The ink barrier outline 14 can be an ink material sold under the trademark FLOWSTOP™ by Development Associates in North Kingston, R.I. The ink barrier outline 14 is printed on surface 12 of polycarbonate sheet 6 by conventional printing methods. The printed ink barrier outline 14 on surface 12 comprises a printed Ink barrier outline located to outline and enclose each printed indicia and prevents the flow of urethane plastic past the periphery outline of printed ink barrier outline 14 during the plastic application process at each of the selected positions of the indicia 10 printed on the thin polycarbonate sheet. The flowable heated urethane plastic becomes firm after cooling the plastic application process material at each of the selected positions and provides a clear transparent membrane surface over each individual selected indicia within the periphery and barriers of each printed ink outline which permits the user to view the individual indicia beneath each transparent membrane structure. The raised dome shape of the individual membrane structures occurs from the plastic application process and the cooling and firming that occurs of the flowable urethane plastic material. The raised dome shape of the individual membrane structures over each individual indicia in predetermined locations on said thin polycarbonate sheet and the soft condition of the individual membrane structures provide a soft tactile touch for the convenience and tactile comfort of the user. The raised dome shape and soft touch provide a means of determining by touch an individual key and thus facilitate the rapid operation of the device. The soft tactile transparent urethane dome membrane structures are manually compressable to activate an electrical switch of the integral electrical switch matrix. The transparent plastic provides visual viewing of the indicia. The thin polycarbonate layer 6 may be colored on surface 12 by conventional printing methods outside the periphery of the printed ink barriers 14 of each transparent urethane plastic membrane structure. Printed colors may also be applied to the opposite surface of polycarbonate layer 6. Polycarbonate layer 6 can be a clear colorless plastic or a suitable color but transparent visually clear plastic.

Substrate 8 can be of a suitable plastic material such as polycarbonate, polyethylene terephthalate and medications thereof, polychloride, and other plastic polymers with suitable material characteristics. These materials include polystyrene, polyethylene, polyvinyl acetate, polyethyline terephthalate glycol. Thickness of plastic substrate 8 Is within the range of from 0.05 to 0.20 inches although greater and lesser thicknesses can be used.

In operation, the tactile keyboard of this invention can be used to control and operate electrical circuits of appliances, communication equipment, electrical machinery, security devices, computer equipment, and similar electrical equipment controlled by external manual inputs.

What is claimed is:

1. An individual membrane keyboard apparatus for use in controlling electrical apparatus wherein individual membrane structures provide tactile sensitivity to the user to determine by touch an individual key of the keyboard to facilitate rapid operation of the keyboard, said individual membrane structure keyboard comprising:

a) a thin polycarbonate sheet with printed indicia thereon in predetermined locations wherein said individual indicia is in the form of numbers, letters and icons to designate an operation element of controlled electrical apparatus, wherein a means of controlling said electrical apparatus comprises an integral electrical switch matrix therein, including actuating switch members to control said electrical apparatus, which is positioned and in alignment with said individual indicia to provide operation elements of said controlled electrical apparatus, said matrix secured to said thin polycarbonate sheet:

b) a printed ink outline located to outline each printed indicia and enclose each printed indicia, said printed ink outline printed on said thin polycarbonate sheet:

c) individual soft tactile transparent urethane plastic dome membrane structures located within barriers of each printed ink outline, each said membrane structure over each individual indicia in predetermined locations on said thin polycarbonate sheet wherein said soft tactile transparent urethane dome membrane structures are manually compressable to activate an electrical switch of said integral electrical switch matrix:

d) a plastic substrate whereon said thin polycarbonate sheet with printed indicia is mounted thereon.

2. The soft tactile transparent urethane plastic dome membrane structures of the individual membrane keyboard apparatus of claim 1 wherein said each individual soft tactile urethane plastic dome membrane structure located within enclosure of each printed ink outline is applied by means of a plastic application process of flowable urethane plastic in a heated state.

3. The individual membrane keyboard apparatus of claim 1 wherein said printed indicia in predetermined locations is by conventional printing processes over said integral electrical switch matrix in said thin polycarbonate sheet.

4. The individual membrane keyboard apparatus of claim 1 wherein said printed ink outline located to outline each printed indicia and enclose each printed indida is by conventional printing processes.

5. The individual membrane keyboard apparatus of claim 1 wherein thickness of said thin polycarbonate sheet is in the range of from about 0.01 to 0.03 inches thick.

6. The individual membrane keyboard apparatus of claim 1 wherein said thin polycarbonate sheet is transparent, clear, possesses a velvet-like texture surface, and is scratch-resistant.

7. The individual membrane keyboard apparatus of claim 1 wherein thickness of said thin polycarbonate sheet is greater than 0.03 inches thick.

8. The individual membrane keyboard apparatus of claim 1 wherein thickness of said plastic substrate is within the range of from 0.05 to 0.20 inches thick.

9. The individual membrane keyboard apparatus of claim 1 wherein said, plastic substrate is selected from plastic materials including polycarbonate, polyethylene terephthalate, polyvinylchloride, polystyrene, polyethylene, polyvinyl acetate, and polyethylene terephthalate glycol.

* * * * *